United States Patent [19]

Wieland

[11] 4,392,431

[45] Jul. 12, 1983

[54] METHOD TO MAINTAIN SMOOTH RUNNING OF INK METERING ELEMENTS IN INK FOUNTAINS OF PRINTING MACHINES

[75] Inventor: Erich G. Wieland, Würzburg, Fed. Rep. of Germany

[73] Assignee: Koenig & Bauer AG, Würzburg, Fed. Rep. of Germany

[21] Appl. No.: 300,848

[22] Filed: Sep. 10, 1981

[30] Foreign Application Priority Data

Sep. 10, 1980 [DE] Fed. Rep. of Germany ..... 3033995

[51] Int. Cl.[3] ..... B41F 31/04; B41L 27/06

[52] U.S. Cl. ..... 101/426; 101/365

[58] Field of Search ..... 101/365, 350, 366, 169, 101/157, 148; 15/256.5, 256.51; 118/261

[56] References Cited

U.S. PATENT DOCUMENTS

| | | | |
|---|---|---|---|
| 1,574,474 | 2/1926 | Faltus | 101/365 |
| 2,183,739 | 12/1939 | Crafts | 101/350 |
| 3,889,793 | 6/1975 | Cattaneo | 400/124 |

*Primary Examiner*—J. Reed Fisher

*Attorney, Agent, or Firm*—Jones, Tullar & Cooper

[57] ABSTRACT

A method and apparatus to maintain smooth operation of ink metering elements in an ink fountain of a printing machine is disclosed. A plurality of ink metering elements are placed side by side in a longitudinal gap in the bottom of the ink fountain. Each of the ink metering elements has a longitudinal bore which extends through the element and which is in communication with lubricant grooves on the faces of each element. A suitable lubricant is forced through the bores of all the ink metering elements and out into the lubricant grooves on the faces of the elements. The use of this lubricant maintains the smooth operation of the ink metering elements by reducing friction between the elements and by removing ink and dirt particles from between adjacent elements. Any particles of ink or dirt which may become entrained in the lubricant can be removed by forcing out the spent lubricant and by adding fresh replacement lubricant.

4 Claims, 2 Drawing Figures

METHOD TO MAINTAIN SMOOTH RUNNING OF INK METERING ELEMENTS IN INK FOUNTAINS OF PRINTING MACHINES

FIELD OF THE INVENTION

The present invention is directed to a method and apparatus for maintaining smooth operation of ink metering elements in an ink fountain. More particularly, the present invention is directed to such a method and apparatus wherein the ink metering elements include means to place lubricant between adjacent elements. Most specifically, the present invention is directed to the method and apparatus for maintaining smooth operation of the ink metering elements wherein lubricant is forced through longitudinal boreholes. The ink metering elements, which cooperate to form an ink metering slot with respect to the periphery of the surface of an ink roller, are positioned in a longitudinal gap in the ink fountain bottom. The ink metering elements are placed side by side in the gap and each such element has a longitudinal bore and lubricant grooves on its front faces. A suitable lubricant is forced through the longitudinal bore and out through the lubricant grooves so that the areas between adjacent ink metering elements are lubricated. The lubricant insures smooth running operation of the ink metering elements by reducing sliding friction between the element faces and by excluding particles of dirt or ink from entering between the faces of adjacent elements.

DESCRIPTION OF THE PRIOR ART

Ink fountains for printing machines are generally known in the art. For example, an ink fountain for use in a printing machine is disclosed in German Unexamined Published Application No. 2,814,889, which corresponds to U.S. Pat. No. 4,170,177 to Iida et al. This patent discloses an ink fountain roller which contacts printing ink in an ink reservoir. A plurality of ink metering elements are placed side by side and in direct contact with each other. These ink metering elements extend longitudinally parallel to the axis of rotation of the ink fountain roller. These ink metering elements are pivotably mounted and are supported in the ink fountain bottom, and are rigidly secured to a pivotable arm. The patent further discloses a controllable mechanism which permits adjustment of a slot formed by the ink metering elements with the surface of the ink fountain roller.

A disadvantage of ink fountains such as the one discussed above is that the ink guiding surfaces of the ink fountain bottom and of the ink metering elements are always disposed at an angle of slightly greater than 90° which makes cleaning of the ink fountain quite difficult. A bottom plate portion of the ink fountain bottom removes printing ink from the ink guiding surfaces of the metering elements as the ink metering elements move in the direction of "More Ink." As the ink is removed from these surfaces, it is known that ink particles get under the bottom plate. These particles of ink have an adverse affect on the ability of the ink metering elements to operate in a smooth manner. Particles of ink and dirt also find their way into the spaces between the ink metering elements and also hinder the smooth operation of the ink metering elements.

SUMMARY OF THE INVENTION

It is an object of the present invention to provide a method and apparatus to maintain smooth operation of ink metering elements in an ink fountain.

Another object of the present invention is to provide a method and apparatus for maintaining such smooth operation where the ink metering elements are arranged side by side.

Yet another object of the present invention is to provide a method and apparatus for maintaining such smooth operation in which the ink metering elements include lubricant receiving means.

As will be discussed in greater detail in the description of the preferred embodiment, as set forth hereinafter, the method and apparatus for maintaining smooth operation of the ink metering elements in an ink fountain in accordance with the present invention includes the provision of a plurality of ink metering elements arranged side by side in a longitudinal gap in the floor of the ink fountain. These ink metering elements extend parallel to the axis of rotation of the ink fountain roller. Each of the ink metering elements has a longitudinal bore which passes through the element and which communicates with lubricant grooves on the front sides of the elements. The longitudinal bores of all the ink metering elements are aligned when the elements cooperate together to meter ink. A suitable lubricant is forced through the longitudinal bores and fills the bores and lubricant grooves. This lubricant aids in smooth operation of the ink metering elements by reducing friction between elements and by excluding particles of ink or dirt from between the adjacent elements. The ink metering elements do not have to be removed from the fountain since cleaning is accomplished by forcing in clean lubricant whereby the old lubricant and any entrained particles of ink or dirt are forced out.

This method and apparatus insures the smooth operation of the ink metering elements so that none of the elements operate sluggishly. This is a particular advantage if stepping motors or the like are used to adjust the positions of the ink metering elements. Since the method and apparatus in accordance with the present invention insures smooth operation of the ink metering elements, it is no longer necessary to utilize an indication means to determine the position of the individual ink metering elements.

BRIEF DESCRIPTION OF THE DRAWINGS

While the novel features of the ink fountain for use in a printing machine in accordance with the present invention are set forth with particularity in the appended claims, a full and complete understanding of the invention may be had by referring to the description of a preferred embodiment as set forth hereinafter and as may be seen in the accompanying drawings in which:

DESCRIPTION OF THE PREFERRED EMBODIMENT

Figure 1:
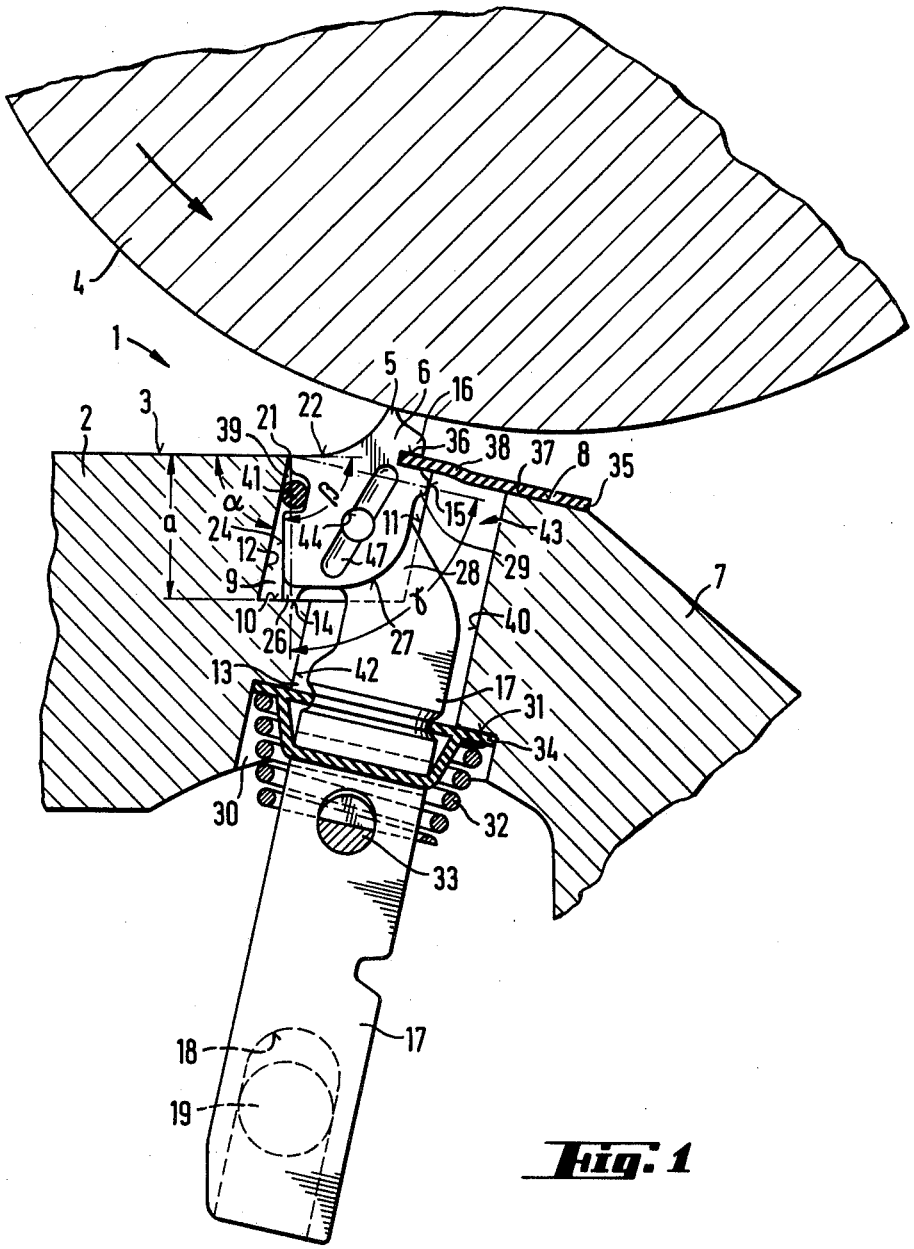
FIG. 1 is a schematic side view of the ink fountain in accordance with the present invention with the ink fountain bottom and ink roller being shown in section and with the lateral end plates removed for clarity.

Turning initially to FIG. 1, there may be seen an ink fountain generally at 1 with an ink fountain bottom member 2 provided therein. An inner bottom surface 3 of ink fountain bottom member 2 is covered with printing ink, when the ink fountain is filled with printing ink. A ceramic-coated ink fountain roller 4, which is driven in a conventional manner, plunges into the ink fountain 1. Ink metering extensions 5 of ink metering elements 6 form a slot with ink fountain roller 4 through which the printing ink passes. The ink fountain bottom 2 extends as an extension of the bottom surface 3 past all of the ink metering elements 6, thus forming a tail piece 7 having a tail face 8. A longitudinal gap 9 is provided in the ink fountain bottom 2, extending down into bottom 2 from the inner bottom surface 3. This longitudinal gap 9 preferably has a rhombus-shaped cross section and extends axially paralllel to an axis of rotation of the ink fountain roller 4 near the point of closest proximity of the ink fountain roller 4 to the ink fountain bottom 2. A left guiding surface portion 12 of the longitudinal gap 9 abuts the bottom surface 3 at an angle $\alpha$, which is preferbly less than 90°, but which can be as great as 90°. An edge formed by the abutment of the left guiding surface 12 and the bottom surface 3 serves as a pivoting edge or pivoting line 21 for the ink metering elements 6. A right guiding surface 11 extends parallel to the left guiding surface 12 of the longitudinal gap 9, and a base surface 10 of the longitudinal gap 9 extends parallel to, and at a depth "a" below the bottom surface 3, of the ink fountain bottom 2. Vertical openings 13 in the ink fountain bottom 2 end in the base surface 10 of the longitudinal gap 9, these vertical openings 12 being spaced along the entire length "b" of the ink fountain bottom, for example, 30 mm from each other. The cross section of each of the openings 13 is dimensioned so that a pivotable arm 17 which is ridigly secured to each ink metering element 6 that extends horizontally in gap 9, is moveable in opening 13. The pivotable arm 17 can move in a preselectable pivoting motion. It is provided for this purpose with an elongated hole 18 in its lower portion. A crank pin 19 which is driven by an electric motor engages this elongated hole 18. The pivotable arm 17 pivots about the point of intersection 21 of the guiding surface 12 with the bottom surface 3 of the ink fountain bottom 2. The pivoting edge 21 for the pivotable arm 17 is also the pivoting edge for each ink metering element 6 which is rigidly secured to the upper end of a corresponding arm 17. The inner bottom surface 3 of the ink fountain bottom 2 adjoins an ink guiding surface 22 of the ink metering elements 6, so that no groove or ridge which might impede the passage of ink over both surfaces 3 and 22 is formed. Ink guiding surface 22 extends initially in a straight direction, then turns into a concave curvature, which ends in an ink metering extension 5.

A vertical surface 24 of the ink metering element forms an angle $\beta$ of approximately 90° with the ink guiding surface 22 of the ink metering element 6 and ends in a first carrier extension 26. This carrier extension 26 projects downwardly approximately 1 mm below a curved rear surface 27 of the ink metering element 6. A collar 28 at the upper end of the pivotable arm 17 is rigidly and permanently joined to the rear surface 27. The rear surface 27 also includes a second carrier extension 29. The first carrier extension 26 rests upon the base surface 10, whereas the second carrier extension 29 rests upon the right guiding surface 11 of the longitudinal gap 9. The carrier extensions 26, 29 each extend preferably over the entire length "c" of the ink metering element 6 and define an angle $\gamma$ of approximately 80°. The carrier extensions 26, 29 may have a rectangular cross section while their front faces or carrier surfaces 14, 15 should be as narrow as possible. The carrier extensions 26, 29 may, however, be blade-shaped or they may have a plane front or a curved front.

A borehole 30 is positioned coaxially with each opening 13 and extends into the side opposite the bottom surface 3 of the ink fountain 1. A plane borehole bottom 31 of each extension borehole 30 forms a surface of action for a conical compression spring 32, which is slipped over the pivotable arm 17. This compression spring 32, is held between the borehole bottom 31 and a bolt 33, which projects through the cross section of the pivotable arm 17 and which bolt 33 is rigidly secured to this arm 17. Both carrier extensions 26, 29 and thus the ink metering element 6 are pulled by the compression spring 32 towards the base surface 10 or the right guiding surface 11 of the longitudinal gap 9, respectively.

An elastic sealing membrane 34 which may be, for example, convex, is inserted between the borehole bottom 31 and the compression spring 32. This sealing membrane 34 has an aperture which sealingly engages the pivotable arm 17, sealing is competely. A sealing effect for the ink fountain bottom 2 is secured by pressing the edge of the sealing membrane 34 against the borehole bottom 31 by means of the compression spring 32. A narrow longitudinal groove 36, which extends the whole length "c" of the ink metering elements 6, is provided in a rear part 16 of each of the ink metering elements 6, above the second carrier extension 29, and receives a first lateral edge 38 of an elastic sealing strip 37 to seal the vertical openings 13 from the ink fountain roller 4. A second lateral edge 35 of the elastic sealing strip 37 is secured to the tail surface 8 of the ink fountain 2 thereby sealing this tail surface 8 of the ink fountain 2. The sealing strip 37 extends as a single element over the entire length "b" of the ink fountain bottom 2, and thus over all the ink metering elements 6 of the ink fountain 1, which are disposed side by side.

An axial groove 39 which extends along the entire length "c" of the ink metering elements 6 and parallel to the axis of rotation of ink fountain roller 4 is located in the vertical surface 24 of the ink metering elements 6 approximately 1 mm below the ink guiding surface 22. This groove 39 receives an elastic sealing cord 41 having, for example, a rectangular cross section. This sealing cord 41 extends without breaks over the length "b" of gap 9. It is of a suitable size so that in every operating position of the ink metering elements 6, the left guiding surface 12 of the longitudinal gap 9 is safely sealed to the vertical surface 24 of the ink metering element 6.

Figure 2:
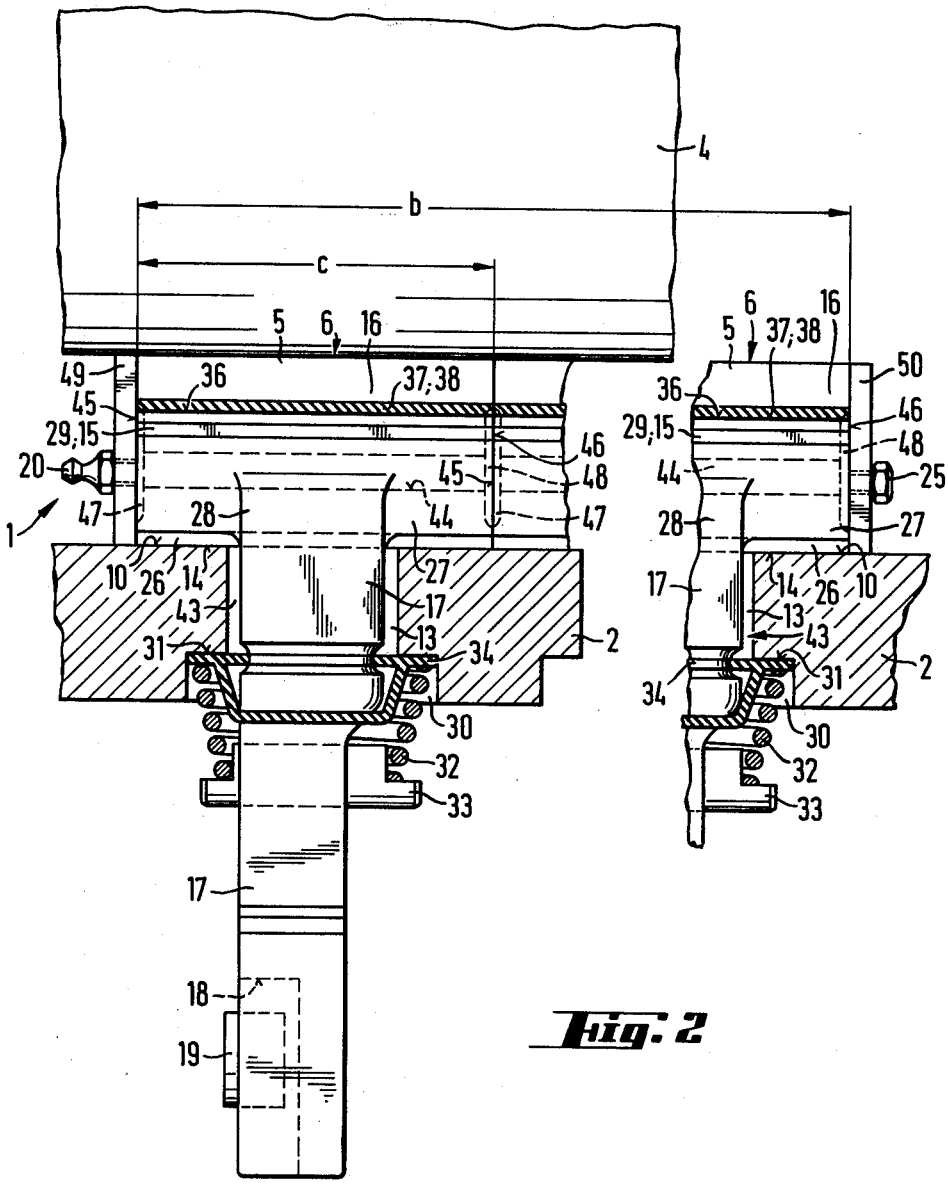
FIG. 2 is a schematic front view of the ink fountain of FIG. 1 with the lateral end plates being shown.

A lubricant chamber 43 which is defined and sealed by the sealing strip 37, a right side face 40 of the opening 13, the sealing membrane 34, a left side face 42 of the opening 13, the base surface 10, the left guiding surface 12, the sealing cord 41, the surfaces 24 and 27 of the ink metering element 6 facing the longitudinal gap 9, and by two lateral end plates 49 and 50, as seen in FIG. 2, extends over the length "b" of the gap 9, and is completely filled with a lubricating means, for example, grease. Printing ink or dirt is thus prevented from penetrating the lubricating means chamber 43 and cannot handicap the operation of the ink metering elements 6.

Each ink metering element 6 is provided with a through borehole 44 in its center. This borehole 44 ends on either front side 45, 46 of ink metering element 6, in a lubricating groove 47, 48 respectively. Every lubricating groove 47, 48 extends within the surface limits of the front sides 45, 46 and is approximately 10 mm long, 2 mm wide, and 0.5 mm deep. A grease nipple 20 is provided on the lateral end plate 49, through which grease can be forced into the boreholes 44 of the ink metering elements 6. An outlet nipple 25, which is capable of being closed and opened, is provided on the second lateral end plate 50, through which waste grease can be forced out. Since all the boreholes 44 of the ink metering elements are in connection with each other, it is possible to press grease through them in a way that the grease is pressed out between the front sides 45, 46 of adjacent ink metering elements 6, thus dirt and ink pigments which may have accumulated between adjacent elements 6 are simultaneously pressed out.

In operation, the crank pins 19 are all caused to rotate by the electric drive motor (not shown), such motion causing the solid pivot arms 17 to pivot about pivot edge 21 whereby the ink metering elements 6, which are rigidly connected to pivotable arms 17, also pivot about pivot edge or line 21 to adjust the spacing between ink metering extension 5 and ink fountain roller 4. The ink in the ink fountain flows smoothly along the inner bottom surface 3 of the ink fountain bottom 2 and along the curving ink guiding surface 22. The lubricating means chamber 43 is sealed by seal 41, by elastic sealing strip 37 and by elastic sealing membrane 34 so that no dirt or ink can get into the longitudinal gap 9. Thus the several ink metering elements 6 which are disposed side by side in gap 9 can operate smoothly and in uniformity to meter the ink applied to roller 4. Similarly, the lubricant which is forced through lubricant hole 44 in each metering element 6 and out through the lubricant grooves 47 and 48 keeps particles of dirt and ink from between end faces 45 and 46 of adjacent ink metering elements 6. Accordingly, the ink fountain in accordance with the present invention includes a plurality of individual ink metering elements which cooperate to uniformly meter ink on an ink roller. Furthermore, the ink fountain in accordance with the present invention allows the ink metering elements to operate smoothly and to remain dirt and ink free.

While an ink fountain for printing machines having means to maintain smooth operation of the ink metering elements in accordance with the present invention has been fully and completely described hereinabove, it will be obvious to one of ordinary skill in the art that a number of changes in, for example, the number of metering elements, the means for pivoting the arms, the securement means for the spring and the like may be made without departing from the true spirit and scope of the invention that the invention is to be limited only by the following claims.

I claim:

1. A method of maintaining smooth running of individually adjustable ink metering elements of an ink fountain having an ink fountain roller in a printing machine wherein a plurality of said ink metering elements are disposed laterally side by side in a row in a bottom portion of said ink fountain parallel to an axis of rotation of said ink fountain roller, said method comprising the steps of: supplying a lubricant through a longitudinal borehole formed in each said ink metering element; and pressing said lubricant from said longitudinal borehole in each said metering element into the space between front sides of immediately adjacent ones of said ink metering elements whereby ink and dirt particles are excluded from said spaces between adjacent ones of said ink metering elements thereby maintaining smooth running of said elements.

2. The method according to claim 1, including the step of positioning said longitudinal boreholes of all said ink metering elements in fluid communication with each other.

3. The method according to claim 2, further including the steps of closing said row of ink metering elements disposed side by side on their extremities by end plates and providing a lubricant feeding device which is in connection with said longitudinal boreholes on at least one of said end plates.

4. The method according to claim 1 wherein the step of pressing said lubricant further includes the step of forcing said lubricating through a lubricating groove in at least one front side of each said ink metering element, said lubricating groove being in fluid communication with said longitudinal borehole.

* * * * *